US005220385A

United States Patent [19]

Surti

[11] Patent Number: 5,220,385

[45] Date of Patent: Jun. 15, 1993

[54] PROCESS CARTRIDGE FOR ELECTROGRAPHIC APPARATUS

[76] Inventor: Tyrone N. Surti, 424 Harding Industrial Dr., Nashville, Tenn. 37211

[21] Appl. No.: 769,219

[22] Filed: Oct. 1, 1991

[51] Int. Cl.[5] ..... G03G 15/06

[52] U.S. Cl. ..... 355/260; 222/DIG. 1; 355/200; 355/245

[58] Field of Search ..... 222/DIG. 1; 355/200, 355/210, 211, 245, 260

[56] References Cited

U.S. PATENT DOCUMENTS 4,615,608 10/1986 Mizutani ..... 222/DIG. 1 X
4,931,838 6/1990 Ban et al. ..... 355/260

*Primary Examiner*—A. T. Grimley
*Assistant Examiner*—P. J. Stanzione
*Attorney, Agent, or Firm*—Phillips & Beumer

[57] ABSTRACT

A process cartridge is provided for use in an electrographic apparatus having control means therein which is actuable responsive to insertion of the process cartridge in the apparatus to control operation of selected elements in the apparatus. The process cartridge is typically provided with a rotatable photosensitive drum upon which an image to be reproduced is formed and a plurality of processing components for acting on the drum. A toner hopper assembly is provided which includes a housing provided with a cavity having toner particles therein for deposition on the drum. The toner hopper defines one of the processing components, and actuating means is secured on the toner hopper for engagement with the control means in the apparatus for actuation thereof.

23 Claims, 6 Drawing Sheets

PROCESS CARTRIDGE FOR ELECTROGRAPHIC APPARATUS

FIELD OF THE INVENTION

This invention relates generally to a process cartridge for use in an electrographic apparatus and more particularly to an improved high-capacity toner cartridge for such process kits.

BACKGROUND OF THE INVENTION

Typically, process cartridges which are used in electrographic apparatuses include a casing which encloses a rotatable electrographic drum and various processing components spaced peripherally around the drum. These components usually include a toner hopper having toner particles therein which form a latent image on the drum in a manner well known in the art. A cleaner housing is provided in peripherally spaced relation to the toner housing and is disposed for removing and storing the used toner particles retrieved from the drum, in a manner well known in the art, after the image has been transferred to a sheet of paper or the like. A corona assembly is provided in peripherally spaced relation to the cleaner housing and is disposed for providing a uniform charge of positive or negative polarity to the drum.

Typically, the above described process cartridge is used in an electrographic apparatus which includes a housing enclosing an optical unit for scanningly deflecting a light from a light source such as a laser onto the photosensitive drum to aid in forming the image thereon. The housing apparatus generally includes upper and lower sections which are separable to provide access therein. The housing of the apparatus also includes paper feed means for feeding sheets of paper past the drum so that the latent image on the drum may be transferred to the paper. After the image transfer function, the paper feed mechanism directs the paper out of the apparatus.

In some instances, the process cartridge does not provide access into the interior thereof which assures that if the drum, cleaner device, or corona is damaged if they have just become expended, or if the toner in the toner housing (hopper) is used up, it is necessary to discard all of the components of the casing, including the casing, so that the casing, drum, corona assembly, toner housing, and cleaner housing must be replaced as a unit.

Generally, the first of the processing components which requires attention is the toner housing since the toner particles are depleted (removed from the housing) during the like time of the process cartridge. When this occurs, as stated above, the process kit must be removed from the apparatus housing and discarded as a unit.

Generally, when such an event occurs, the remaining components which are discarded have not expired and have a considerable amount of "lifetime" remaining.

It is an object of the present invention, therefore, to provide a process cartridge for use in electrographic apparatuses which will have a longer "lifetime" than those generally now available.

It is a feature of the present invention to provide such a process cartridge with an enlarged toner capacity without the need to increase the size or change the external configuration of the casing of the process cartridge.

Another feature of the present invention is the provision of means for assuring that substantially all of the toner in the toner housing is made available for use by eliminating areas in the toner housing which inherently "trap" toner particles in the housing and thus result in unused toner being left in the toner housing which is to be discarded.

These and other objects and features of the present invention will become more readily apparent from the following description taken in conjunction with the accompanying drawings.

DESCRIPTION OF THE PREFERRED EMBODIMENT

Figure 1:
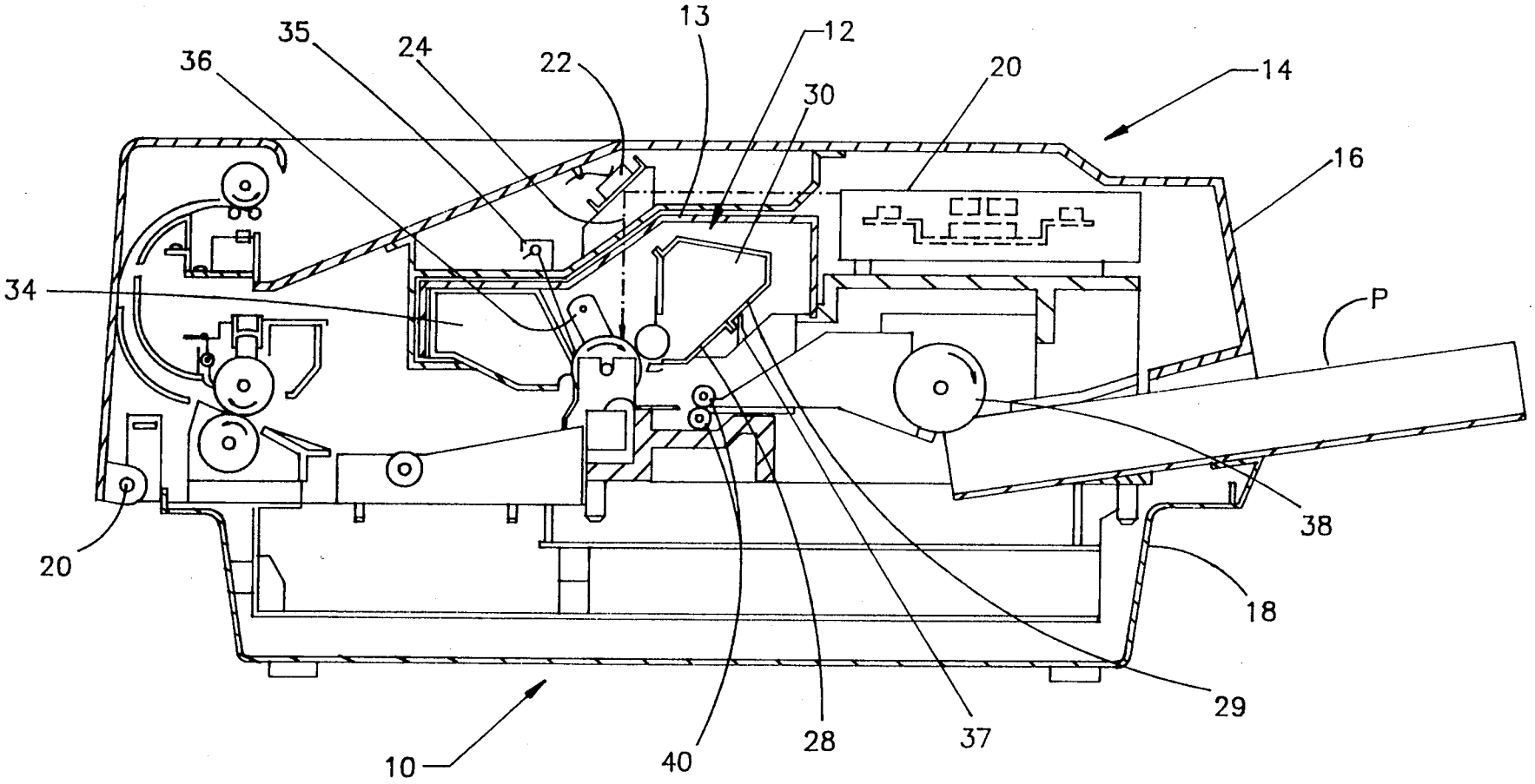
FIG. 1 (PRIOR ART)
FIG. 1 is a sectional view of an electrographic apparatus according to the present invention. The view generally illustrates a process cartridge therein. The process cartridge illustrates the general shape and relative positions of the toner hopper with roller and magnet assemblies secured thereto, the photosensitive drum, the cleaner housing, and the pre-charging corona device.
Figure 4:
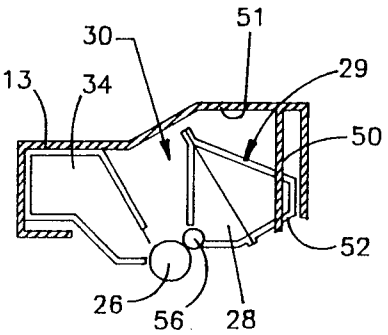
FIG. 4 (PRIOR ART)
FIG. 4 is a sectional view taken along line 4—4 of the prior art device of FIG. 2.

As seen in FIG. 1, an electrographic apparatus 10 is shown to include therein a process cartridge 12 including a casing 13. Apparatus 10 includes a housing 14 having upper and lower sections 16 and 18 pivotally secured together by a hinge assembly 20 so that upper section 16 may be raised to provide access into housing 14. As can be seen, housing 14 further includes a paper and paper tray mechanism designated by the letter P. A laser 20 and associated optics 22 mounted in the apparatus housing is shown directing a beam of laser light 24 onto a photosensitive drum 26 mounted in process cartridge 12. A toner housing assembly 30 is shown to include a pair of sections 28 and 29. Section 28 houses toner particles therein and is positioned adjacent to section 29, which houses drum 26 and a magnet 29. Spaced around the drum in cartridge 12 is a cleaner housing 34 and a corona charge 36. The structure described above is disclosed in U.S. Pat. No. 4,785,319, issued Nov. 15, 1988.

In the general operation of the apparatus, the drum is first exposed to a pre-exposure lamp 35 mounted in apparatus housing 14, and then uniformly charged to a negative or positive polarity by charger 36 and then rotated past the beam of light 24 which directs information light to the drum. The drum is then rotated past the toner housing to receive toner particles for formation of an image containing the information in light beam 24. This image is then passed onto a sheet of paper or the like which has been fed to the drum by a paper feed mechanism including a roller 38 and a pair of smaller rollers 40. The drum continues to rotate past cleaner housing 34, which scrapes and collects toner particles off the drum surface.

A paper feed control mechanism 37 (FIG. 1) is typically provided to control the alignment of the paper relative to the drum. In such cases, the process cartridge is provided with a tab 50 (FIGS. 1–4) which depresses a paper feed control mechanism to assure proper alignment of the paper relative to the drum. The tab engages the actuator of the paper feed control mechanism upon closing of the upper and lower sections of apparatus housing 14. The position of the tab (and problems created thereby) are discussed hereinbelow.

It has been found that before the drum, corona, and cleaner assembly have completed their "life expectancy," the toner particles in the toner housing assembly tend to be expended. This requires that the cartridge including the processing components and cartridge casing be discarded and the unit be completely replaced. The solution to such costly replacement would be to make each process component individually replaceable or to, at the very least, provide a toner housing having a larger toner particle capacity. Heretofore, this has not been done in cartridges as disclosed herein because it has been difficult to design a toner housing which can still fit into the existing size cartridge casing.

One limitation which restricts the size of the toner particle housing is that in existing cartridges (as, shown in FIG. 2), tab 50 (as discussed above) is mounted on the upper interior surface 51 which of casing 13 and extends downwardly from this upper interior surface 51 (FIG. 4) and through an opening 52 in a laterally extending shoulder 53 (FIG. 3) of the toner housing. This tab is used to activate a switch in the housing of the apparatus for paper feed control and occupies space in casing 13 which could otherwise be used to accommodate a larger toner hopper.

Figure 5:
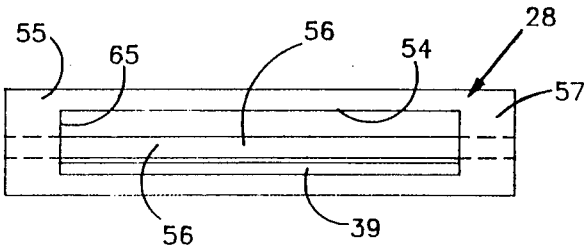
FIG. 5 (PRIOR ART)
FIG. 5 is a sectional view taken along line 5—5 of FIG. 2.

Another limitation which restricts the size of the toner housing (hopper) is the size of the opening 54 (FIG. 5) in section 28 of the toner housing assembly 30 which supports a roller 56 and magnet 39 which cooperate to transfer the toner particles to the drum surface, as is well known in the art. Typically, also as is well known in the art, the toner cartridge 30 is manufactured in two sections, one section enclosing the toner particles for storage thereof, and the second section enclosing roller and magnet assemblies as discussed above. Section 28 is provided with the opening 54 to allow the particles to pass through from section 28 for deposition onto the surface of the drum by roller 56. During the manufacturing process, a thin, removable divider sheet (plastic, etc., not shown) is interposed between these two sections 28 and 29 so that the toner particles are isolated from the roller and magnet section during storage and transportation of the toner housing assembly. The two sections are ultrasonically welded or otherwise permanently secured together with this removable divider between them. When it is time to use the cartridge, the divider is removed by pulling on the end thereof, and toner particles are allowed to fall in the magnet/roller section 28 for transfer to the drum.

Figure 2:
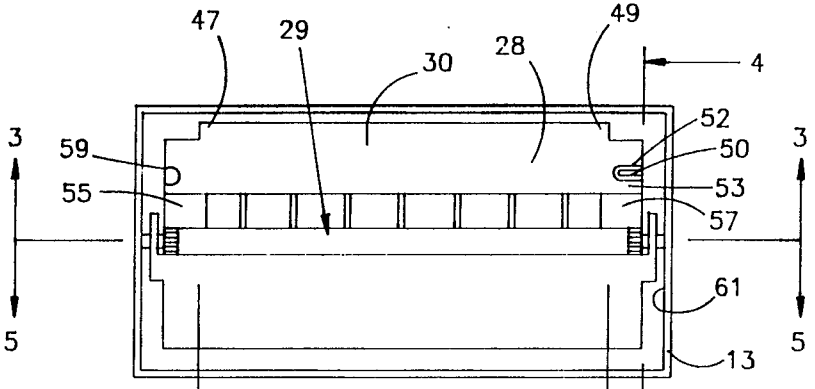
FIG. 2 (PRIOR ART)
FIG. 2 is a bottom view of a prior art process cartridge illustrating the cartridge casing, toner hopper, photosensitive drum, cleaner housing, and a tab extending from the casing for contacting a control member of the electrographic apparatus in which the cartridge is used.
Figure 3:
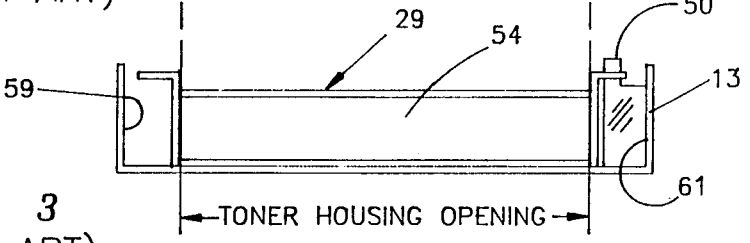
FIG. 3 (PRIOR ART)
FIG. 3 is a sectional view along line 3—3 of the prior art device of FIG. 2 illustrating the size of the toner hopper and cleaner housing opening. The figure also illustrates the positioning and configuration of the tab shown in FIG. 2.

Typically, the size of the opening 54 in the magnet/roller section 28 is controlled by the size of the end sections 55 and 57 which are required between the ends of the roller 56 and the adjacent sides 59 and 61 of the cartridge (FIG. 2). These spaces are generally occupied by a roller drive gear assembly (not shown) at one end and by electrical contacts (not shown) at the other end of the magnet/roller housing section 28. These sections are generally illustrated at sections 55 and 57 of FIGS. 2, 5, and 6.

Figure 10:
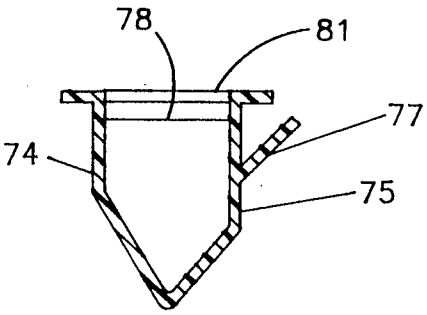
FIG. 10 is an end elevational view taken along line 10—10 of FIG. 7.
Figure 7:
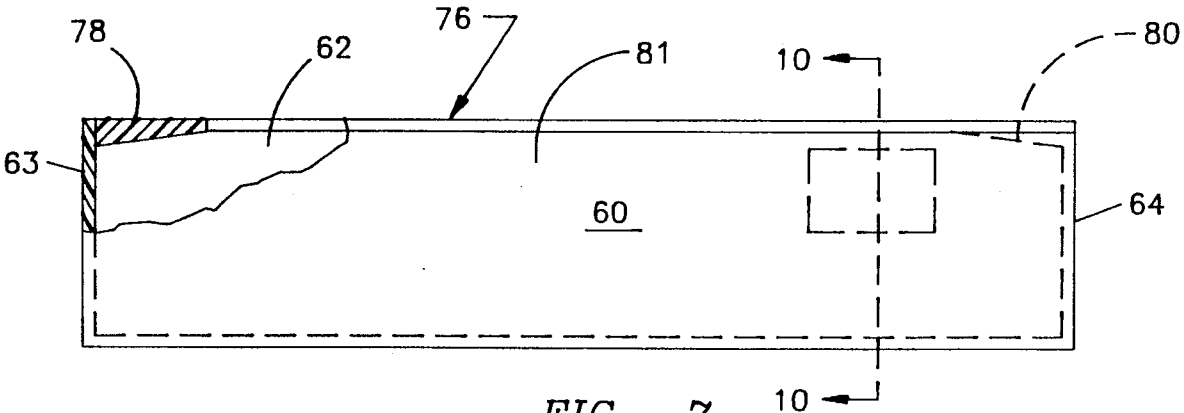
FIG. 7 is an enlarged elevational view, partially in section, of the toner particle reservoir section of the toner housing assembly of the present invention.

FIG. 10 is a sectional view taken along line 10—10 of FIG. 7 and illustrates the casing 60 as having two side walls 71 and 73 and a tab 77 extending from side wall 73 of the casing. As can be seen, the tab is provided on a side surface of the toner casing and not as part of thee cartridge casing 13. Tab 77 is disposed for actuating the mechanism 37 of the printer as discussed, supra. It is because of the fact that tab 50 (which extended across the cartridge casing of the prior art device) has been removed from the casing that the length of the toner hopper can be extended, thereby increasing the capacity of the toner hopper.

Figure 6:
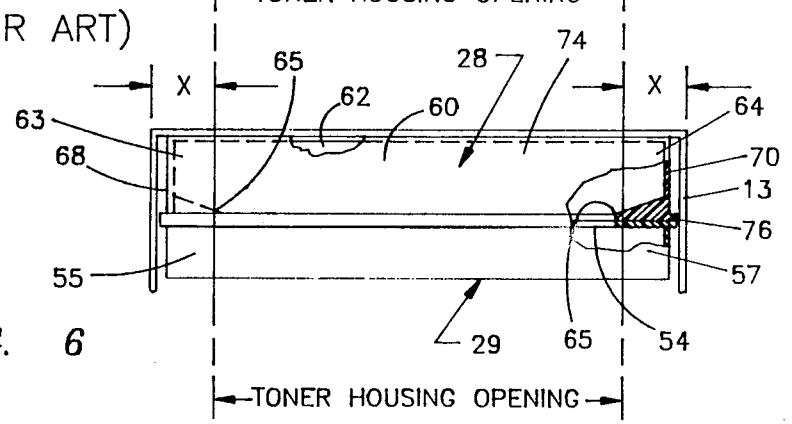
FIG. 6 is an elevational view of the toner housing assembly of the present invention.

To provide an enlarged capacity toner housing as illustrated in FIG. 6, applicant has removed tab 50 from the interior surface 51 (as shown in FIG. 2) of the cartridge casing and has used this space to extend an end 64 of the toner particle housing into. Likewise, the opposite end 63 of the toner housing has been extended. The letter "X" (FIG. 6) designates the extended length of these extended ends of the toner housing.

Figure 9:
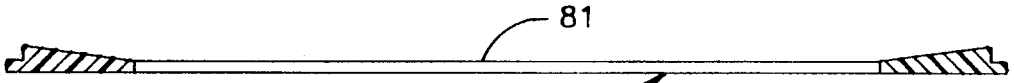
FIG. 9 is a sectional view taken along line 9—9 of FIG. 8.
Figure 8:
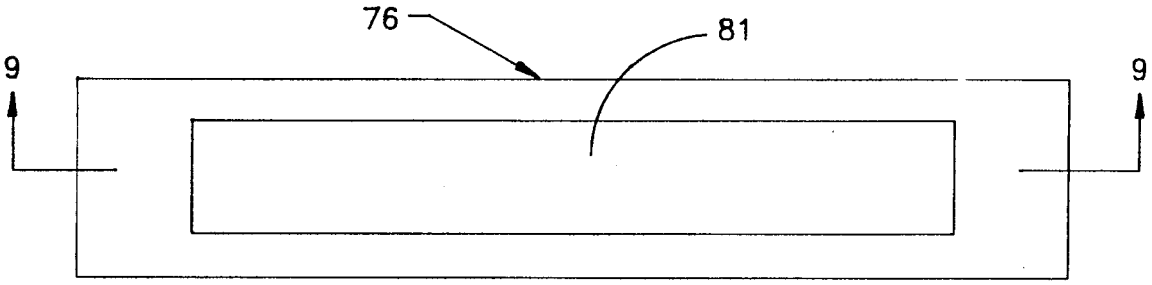
FIG. 8 is a plan view of a cover for the toner reservoir section of FIG. 7.

Applicant's toner particle housing assembly as illustrated includes a casing 60 (FIGS. 6, 7, 8, and 10) having a cavity 62 therein which extends, at both ends 63 and 64 thereof, beyond the ends of opening 65 of the magnet/roller housing. The end walls 68 and 70 of the toner particle housing section 28 extend in normal relation to the side walls 74 and 75 of housing section 28 and, if not compensated for, would create pockets at the mating surface juncture of the magnet/roller housing 29 and the toner particle housing section 28. Applicant has, however, provided the toner housing with a cover 76 having end surfaces 78 and 80 (FIGS. 7–9) which are angled inwardly toward the opening 81 of the cover. The opening 81 in cover 76 is in substantial alignment with the opening 54 of magnet/roller housing section 29 when the two sections are assembled.

If desired, other means may be resorted to assure that substantially all of the toner particles in the toner housing is made to be removed from the housing to be used in the processing procedure. If desired, the end sloped surfaces 78 and 80 may be provided as the inner surfaces 73 and 75 of housing section 29.

Figure 11:
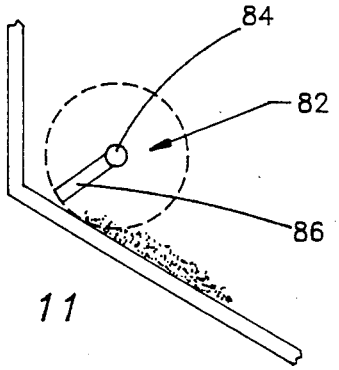
FIGS. 11 and 12 are diagrammatic, partial sectional views of rotational devices which may be used to sweep toner particles from the end angles surfaces of the toner hopper.
Figure 12:
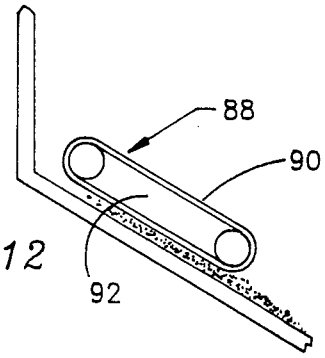
Figure 13:
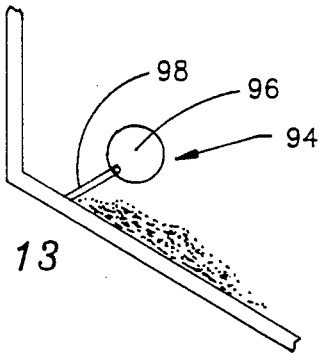
FIG. 13 is a diagrammatic, partial sectional view of a device for imparting vibratory movement of the hopper to remove residual toner particles therefrom.

As seen in FIGS. 11–13, a wiper arrangement is provided at each angled end of the toner housing to remove substantially all of the toner particles from the toner housing. FIG. 11, for example, illustrates a wiper assembly 82 including a rotatable shaft 84 housing a wiper blade 86 secured thereto. The blade extend across the width of the toner housing section 28 to wipe particles out of the housing.

Figure 12A:
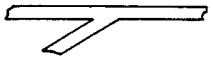
FIGS. 12*a*–12*c* are various angular dispositions of thee extending blade 92 of FIG. 12.
Figure 12B:
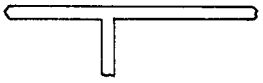
Figure 12C:
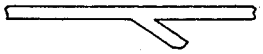

FIG. 12 illustrates a wiper assembly 88 including an endless rotatable belt 90 having either a single or a plurality of blades 92 extending therefrom. FIGS. 12*a*, 12*b*, and 12*c* illustrated various angular dispositions of the extending blade 92 of FIG. 12.

FIG. 13 illustrates yet another manner in which substantially all of the toner is removed from the toner housing. In this embodiment, a shaker device 94 is provided to impart a shaking motion to the toner housing to cause the toner particles to move down the inclined surfaces of the toner cover housing. As can be seen in FIG. 13, the shaker device includes a rotatable shaft 96 provided with a blade 98 (which may be of a hard material, such as metal or plastic) extending therefrom. The blade is mounted off-center relative to the shaft and strikingly engages the inner surface of the toner housing during its rotation. Such striking of the housing by the blade imparts a shaking or vibratory movement to the housing to cause the toner particles to move down the inclined surfaces.

To provide rotation to the shafts in the embodiments of FIGS. 12, and 13, an end of rotatable shaft may have a gear thereon which, through an appropriate gear train mechanism (not shown), may be driven by the gear already provided on the drum. Or, if desired, rotational drive power may be provided externally from other sources.

Figure 14:
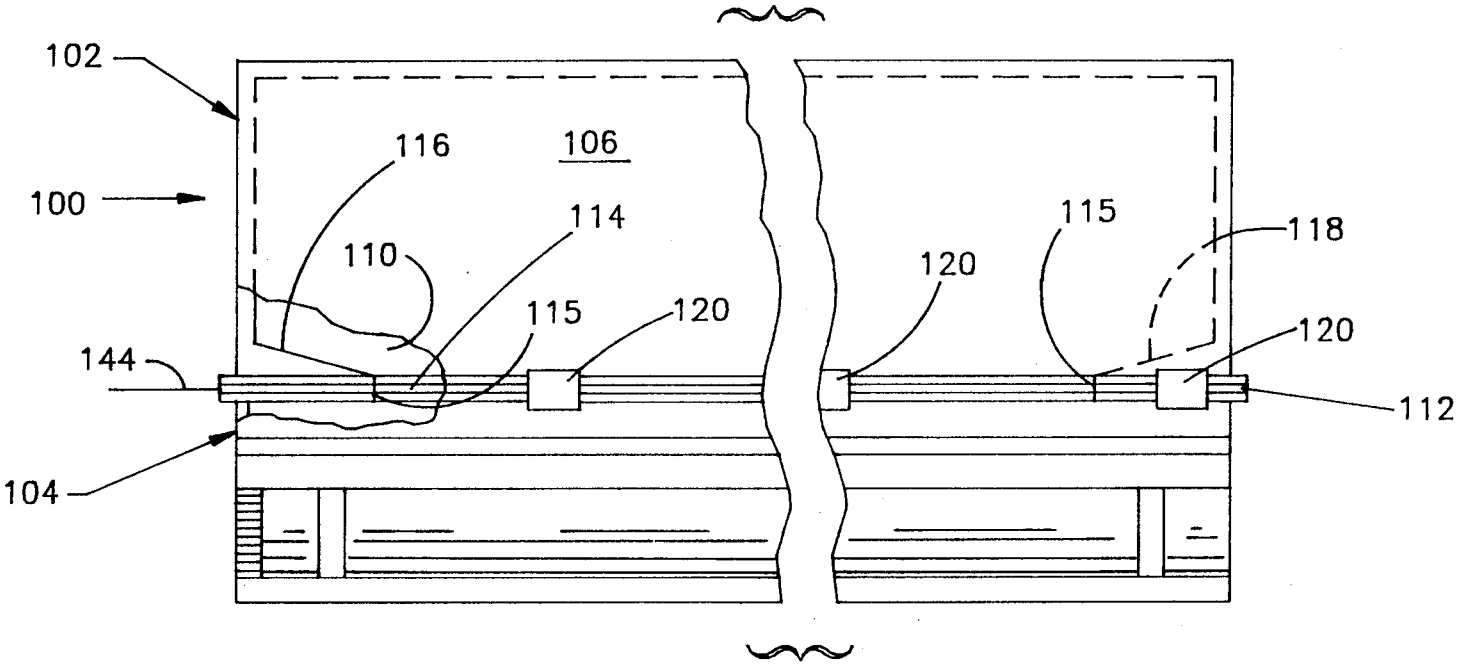
FIG. 14 is an elevational view of a toner housing assembly.

FIG. 14 illustrates another embodiment of a toner particle housing assembly which may be used in process cartridges wherein the toner particle housing assembly may be disassembled for refurbishing or replenishing. In this embodiment, a toner particle housing assembly 100 includes a pair of housing sections 102 and 104. Section 102 includes a body 106 having a cavity 110 therein in which toner particles are stored. Magnet/roller section 104 is releasably secured to housing section 102. A cover 112 provided with an opening 114 therein is secured to toner body section 106 and includes angled surfaces 116 and 118 at opposite ends of opening 114 as discussed above. The opening 114 is in alignment with an opening 115 in the magnet/roller section 104 so that toner particles may pass from body section 102 into magnet/roller section 104 to be subsequently deposited on the drum as is well known.

Figure 15:
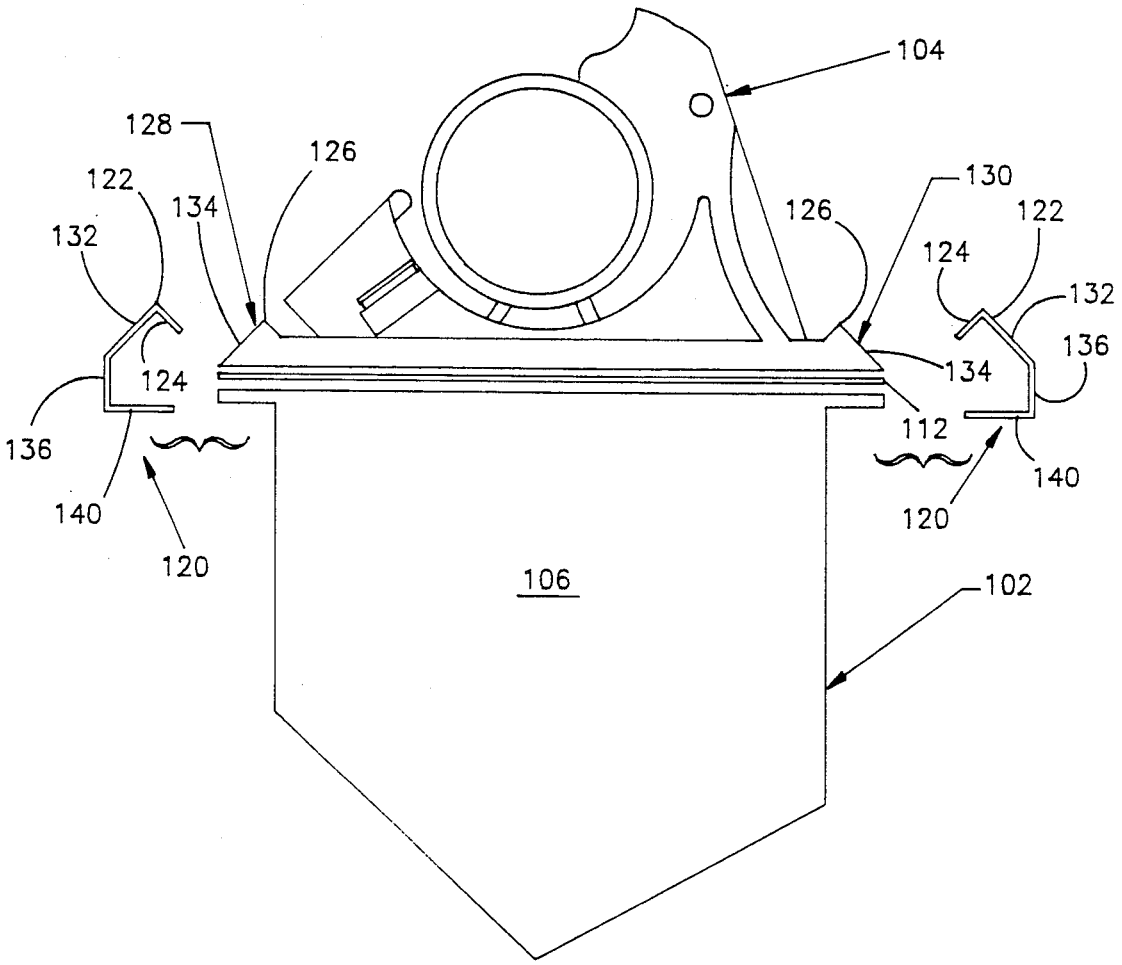
FIG. 15 is an enlarged end elevational view taken along line 15—15 of FIG. 14.

To enable the cover 112 to be removed so that access may be had into the interior of the toner housing, a plurality of spring clips 120 are disposed along the sides of the housing and cover. The spring clips 120 (FIG. 15) include an upper portion 122 having a downwardly extending tip 124 which engages a ridge 126 extending along each of a pair of flanges 128, 130 of the cover. Each spring clip 120 includes an angled portion 132 for engaging an angled portion 134 of flanges 128 and 130 and a downwardly extending portion 136 for engaging the sides of flanges 128 and 130. An inwardly extending portion 140 of each spring clip engages the bottom surface 142 of flange 130.

FIG. 14 illustrates a removable storage separator 144 which is placed between housing sections 102 and 104 during the manufacturing process. The separator keeps the toner particles from entering the magnet/roller section 104 during storage and transportation of the cartridge and is removed just before the cartridge is inserted in the apparatus 10 for use. To remove the storage separator, it is only necessary to pull on an end of the separator which extends longitudinally out of an end of the assembly. It is to be understood that the toner housing of this embodiment may use the wiper blades and shaker assemblies shown in FIGS. 11–13, if desired.

I claim:

1. A process cartridge for use in an electrographic apparatus having control means actuable responsive to insertion of said process cartridge therein to control operation of selected elements in said apparatus, said process cartridge having a rotatable photosensitive drum upon which an image to be reproduced is formed and a plurality of processing components for acting on said drum, said cartridge comprising:

a toner hopper assembly including a housing provided with a cavity having toner particles therein for deposition on said drum to form said latent image, said toner hopper defining one of said processing components; and actuating means secured on said toner hopper for engagement with said control means of said apparatus for actuation thereof.

2. Apparatus as in claim 1 wherein said actuating means is a tab extending from said hopper assembly housing for engaged relation with said control means of said apparatus.

3. Apparatus as in claim 2 wherein said tab is integrally molded to said toner hopper.

4. Apparatus as in claim 3 wherein said toner housing assembly is provided with first and second sections disposed in secured relation, said first section having a first cavity serving as a storage reservoir for said toner particles, and said second section having a second cavity for receiving said toner particles from said first section and for transferring said toner particles to said drum for the formation thereon of said latent image.

5. Apparatus as in claim 4 wherein said first and second housing sections are provided, respectively, with first and second longitudinal openings communicating with their respective cavities and with each other.

6. Apparatus as in claim 5 wherein said second longitudinal opening is smaller than said first longitudinal opening.

7. Apparatus as in claim 6 including particle guide means provided in said first cavity and adapted for directing substantially all of said toner particles from said first cavity into said smaller second opening of said second cavity.

8. Apparatus as in claim 7 wherein said first housing section includes spaced end walls, and said particle guide means is defined by sloped surfaces disposed in angular relation with said end walls for directing said toner particles toward said first longitudinal opening and into said second longitudinal opening of said second housing section.

9. Apparatus as in claim 8 wherein said sloped surfaces are provided on said end walls.

10. Apparatus as in claim 8 including a cover member disposed for secured relation to said first section of said housing assembly, said cover member having said sloped surfaces thereon in extending relation into said first cavity.

11. Apparatus as in claim 10 including retaining means for removably mounting said cover to said second housing section.

12. Apparatus as in claim 11 wherein said retaining means is defined by spring clip members.

13. Apparatus as in claim 12 wherein said first and second housing sections includes longitudinally extending flange portions disposed for mating relation, said spring clip members disposed for engaging said flange portions for secured relation thereof.

14. A process cartridge for use in an electrographic apparatus having a rotatable photosensitive drum upon which a latent image to be reproduced is formed and a plurality of processing components for acting on said drum, said cartridge comprising:

a toner hopper assembly including first and second housing sections;

said first housing section having spaced end walls and a toner particle holding cavity therein and a first opening in communication with said cavity for directing toner particles therethrough;

said second housing section enclosing a second cavity and provided with a second opening in communication with said second cavity which is smaller than said first opening of said first housing and which is in communication with said first opening; and particle guide means carried in said first housing for directing said toner particles into said second housing, said guide means disposed for providing that substantially all of said particles from the larger said cavity of said first housing section is disposed for emptying into said second section, said particle guide means comprising a sloped surface disposed adjacent to said spaced ned walls, said sloped surface being downwardly sloped from said spaced end walls toward said first opening.

15. Apparatus as set forth in claim 14 wherein said sloped surfaces are provided on said end walls.

16. Apparatus as set forth in claim 14 wherein said first section of said toner housing assembly is provided with a cover member disposed for secured relation to said first section of said housing, said cover member having said sloped surfaces thereon in extending relation into said first cavity.

17. Apparatus as set forth in claim 16 including retaining means for removably mounting said cover to said first section of said housing.

18. Apparatus as set forth in claim 17 wherein said retaining means is defined by spring clip members.

19. Apparatus as in claim 18 wherein said first and second housing sections includes longitudinally extending flange portions disposed for mating relation, said spring clip members disposed for engaging said flange portions for secured relation thereof.

20. Apparatus as set forth in claim 19 wherein said flange portion of said cover is provided with a raised ridge thereon, and said spring clip member includes an upper section provided with a downwardly extending top portion for releasably secured engagement with said raised ridge.

21. Apparatus as set forth in claim 20 wherein said flange portion of said body includes a bottom surface, and said spring clip member including a lower inwardly extending section for engagement with said lower bottom surface.

22. A process cartridge for use in an electrographic apparatus having control means actuable responsive to insertion of said process cartridge therein to control operation of selected elements in said apparatus, said process cartridge having a rotatable photosensitive drum upon which an image to be reproduced is formed and a plurality of processing components for acting on said drum, said cartridge comprising:

a toner hopper assembly including a plurality of walls forming a housing provided with a cavity having toner particles therein and a longitudinal opening through which said toner particles are directed for deposition on said drum to form said latent image, said toner hopper defining one of said processing components; and actuating means secured on said toner hopper for engagement with said control means of said apparatus for actuation thereof, said actuating means being defined by a tab extending from said hopper assembly housing for engaged relation with said control means of said apparatus, and particle guide means carried in said hopper housing for assuring that substantially all of said toner particles are directed out of said hopper housing during the "lifetime" of said hopper, said guide means being defined by sloped surfaces carried in said hopper housing, said sloped surfaces disposed in angular relation with said walls and said longitudinal opening for directing said toner particles therethrough.

23. Apparatus as set forth in claim 22 including means carried in said hopper housing for moving said toner particles down said sloped surfaces.

* * * * *